US009317002B2

(12) United States Patent
Katsuyama

(10) Patent No.: US 9,317,002 B2
(45) Date of Patent: Apr. 19, 2016

(54) IMAGE FORMING APPARATUS INCLUDING AN ANGLE-ADJUSTABLE OPERATING MEMBER

(71) Applicant: Goro Katsuyama, Kanagawa (JP)

(72) Inventor: Goro Katsuyama, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 50 days.

(21) Appl. No.: 14/260,839

(22) Filed: Apr. 24, 2014

(65) Prior Publication Data

US 2014/0328605 A1 Nov. 6, 2014

(30) Foreign Application Priority Data

May 2, 2013 (JP) ..... 2013-097107
Mar. 7, 2014 (JP) ..... 2014-044812

(51) Int. Cl.
*G03G 21/16* (2006.01)
*G03G 15/00* (2006.01)

(52) U.S. Cl.
CPC ..... *G03G 21/1647* (2013.01); *G03G 15/502* (2013.01); *G03G 21/1623* (2013.01); *G03G 15/5016* (2013.01)

(58) Field of Classification Search
CPC ..... G03G 21/1647; G03G 21/1623; G03G 15/502; G03G 15/5016
See application file for complete search history.

(56) References Cited

U.S. PATENT DOCUMENTS

| | | | | |
|---|---|---|---|---|
| 2002/0150403 | A1 | 10/2002 | Katsuyama et al. | |
| 2002/0195915 | A1 | 12/2002 | Katsuyama et al. | |
| 2003/0052956 | A1 | 3/2003 | Katsuyama | |
| 2003/0170041 | A1 | 9/2003 | Katsuyama | |
| 2004/0114958 | A1 | 6/2004 | Katsuyama et al. | |
| 2005/0109883 | A1 | 5/2005 | Watanabe et al. | |
| 2009/0103251 | A1* | 4/2009 | Suzuki et al. | 361/679.02 |
| 2011/0181903 | A1 | 7/2011 | Katsuyama et al. | |
| 2012/0294645 | A1 | 11/2012 | Shimada et al. | |
| 2013/0283944 | A1* | 10/2013 | Koyanagi et al. | 74/89.18 |

FOREIGN PATENT DOCUMENTS

| | | |
|---|---|---|
| JP | 2001-242673 | 9/2001 |
| JP | 2005-085936 | 3/2005 |
| JP | 2006-251218 | 9/2006 |
| JP | 2013-008011 | 1/2013 |

* cited by examiner

*Primary Examiner* — Joseph S Wong
(74) *Attorney, Agent, or Firm* — Harness, Dickey & Pierce, P.L.C.

(57) ABSTRACT

An image forming apparatus includes an operating member operated by an operator to give an instruction on operation; a top exterior member that is formed with a holding recess in which the operating member is arranged; a first mounting part provided on the holding recess, on which the operating member is mounted in a first posture in which the operating member is inclined by a first inclination angle with respect to the top exterior member; and a second mounting part provided in the holding recess, on which the operating member is mounted in a second posture in which the operating member is inclined by a second inclination angle different from the first inclination angle with respect to the top exterior member. The operating member is configured to be selectively mounted either on the first mounting part or on the second mounting part with use of a mounting member.

8 Claims, 15 Drawing Sheets

IMAGE FORMING APPARATUS INCLUDING AN ANGLE-ADJUSTABLE OPERATING MEMBER

CROSS-REFERENCE TO RELATED APPLICATIONS

The present application claims priority to and incorporates by reference the entire contents of Japanese Patent Application No. 2013-097107 filed in Japan on May 2, 2013 and Japanese Patent Application No. 2014-044812 filed in Japan on Mar. 7, 2014.

BACKGROUND OF THE INVENTION

1. Field of the Invention

The present invention relates to an image forming apparatus including an angle-adjustable operating member on a top exterior member.

2. Description of the Related Art

In an image forming apparatus, an operating member is usually fixed so as to be inclined by a predetermined angle with respect to a top exterior surface of a main body of the apparatus by taking into account the line of sight of an operator or the operability.

However, in the fixed operating member, a room light may be reflected in or reflection may occur from a display unit that is provided on the operating member and that performs various displays; therefore, the visibility may be reduced. Furthermore, the operating member of the image forming apparatus as described above is usually mounted on the top surface of the apparatus; therefore, the mounting position of the operating member may be too high for a user in a wheel chair to operate.

Therefore, an apparatus including an angle changing mechanism that can change the angle of the operating member with respect to the exterior of the main body of the apparatus has been proposed. Japanese Laid-open Patent Publication No. 2001-242673 discloses an electrophotographic apparatus that includes a display unit with a liquid crystal screen and includes a posture changing means that changes the posture of the liquid crystal screen with respect to a main body of the electrophotographic apparatus.

However, in the apparatus disclosed in Japanese Laid-open Patent Publication No. 2001-242673, a rotary shaft for changing the angle of the operating member is provided on the side surface or the bottom surface of the operating member, so that the structure tends to be complex, downsizing is difficult, and costs for components increase.

Therefore, there is a need for an image forming apparatus capable of reducing costs for components and the size of the apparatus.

SUMMARY OF THE INVENTION

According to an embodiment, an image forming apparatus includes an operating member that is operated by an operator to give an instruction on operation; a top exterior member that is formed with a holding recess in which the operating member is arranged; a first mounting part provided on the holding recess, on which the operating member is mounted in a first posture in which the operating member is inclined by a first inclination angle with respect to the top exterior member while the operating member is being held by the holding recess; and a second mounting part provided in the holding recess, on which the operating member is mounted in a second posture in which the operating member is inclined by a second inclination angle different from the first inclination angle with respect to the top exterior member. The operating member is configured to be selectively mounted either on the first mounting part or on the second mounting part with use of a mounting member.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
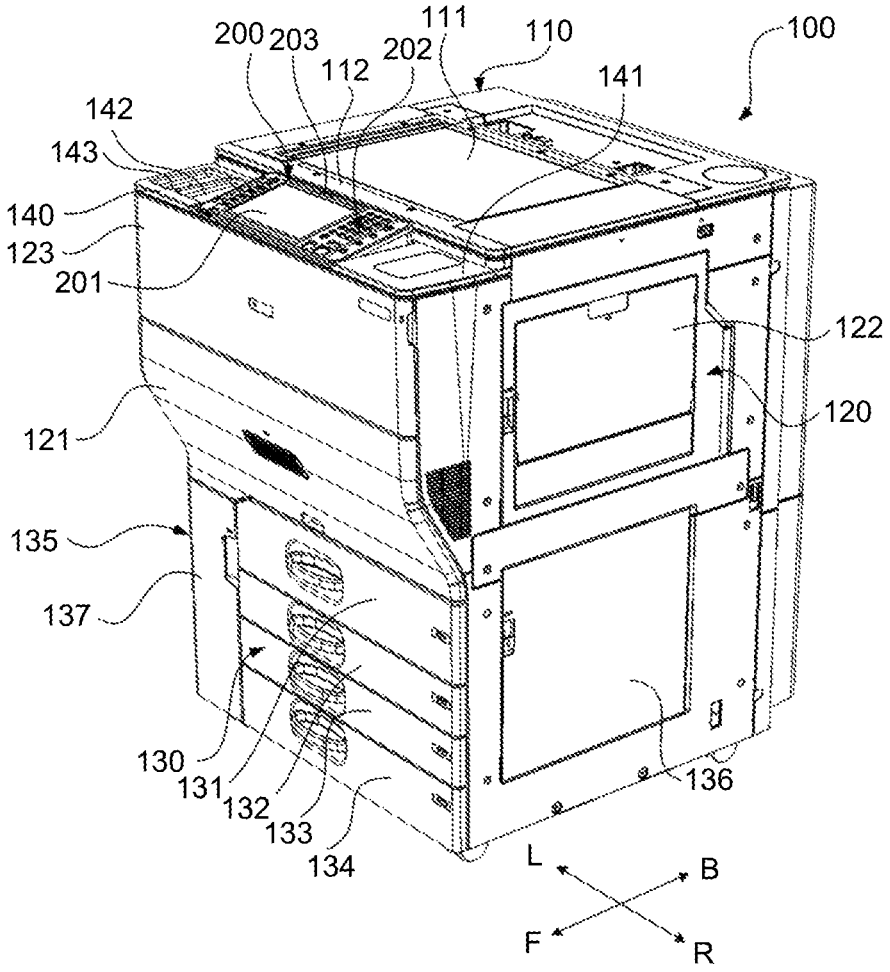
FIG. 1 is a perspective view illustrating an appearance of an image forming apparatus according to an embodiment of the present invention.
Figure 2:
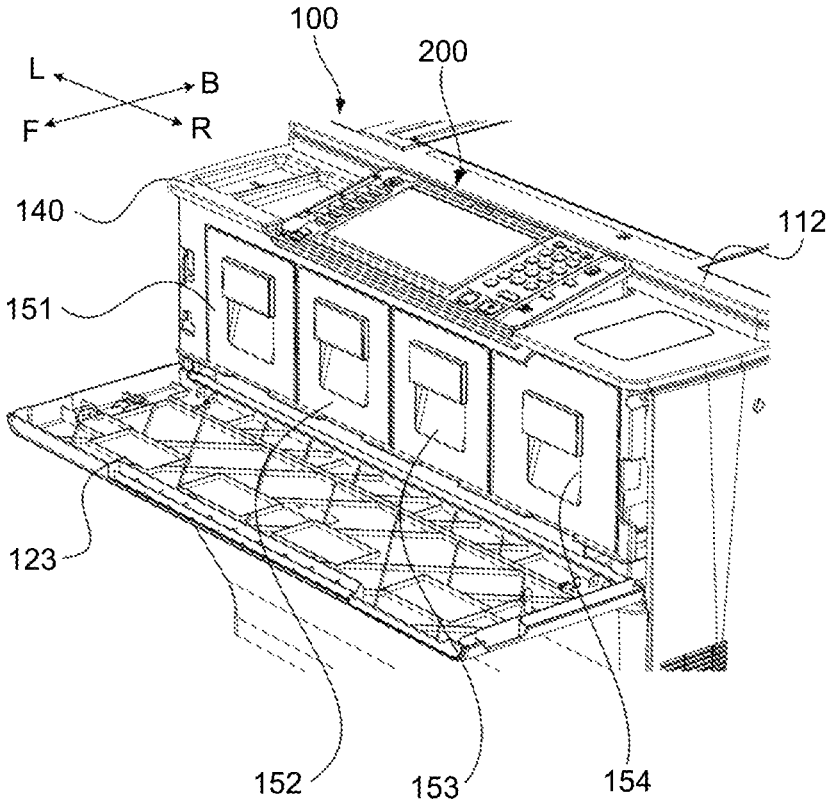
FIG. 2 is a perspective view illustrating a state in which a toner replacement door of the image forming apparatus is opened.

Exemplary embodiments of an image forming apparatus according to the present invention will be explained below. First, an overall structure of the image forming apparatus will be described. FIG. 1 is a perspective view illustrating an image forming apparatus according to an embodiment of the present invention. FIG. 2 is a perspective view illustrating a state in which a toner replacement door of the image forming apparatus is opened. An image forming apparatus 100 includes a document reading unit 110 that optically reads documents, an image forming unit 120 that forms an image on a recording medium such as a sheet by an electrophotographic method, and a sheet storage unit 130 for storing sheets according to sheet sizes. The image forming apparatus 100 further includes an operating member 200 that gives an instruction on operation of the image forming apparatus. The operating member 200 is arranged on a top surface of the document reading unit 110 of the image forming apparatus 100 on an operator stand side (front side), where an operator of the document reading unit 110 stands, along a width direction (left-right direction) on a top exterior panel 140 serving as a top exterior member. In the drawings, the front side is indicated by F, the rear side is indicated by B, the right side is indicated by R, and the left side is indicated by L.

On the top surface of the document reading unit 110, a contact glass 111 as a document reading surface and a frame 112 are arranged. A pressurizing plate for pressing a document against the contact glass 111 and an auto document feeder (ADF) (both of which are not illustrated) are arranged above the document reading unit 110.

The image forming unit 120 houses an image forming unit that forms a full-color toner image by using toners of four colors of yellow, magenta, cyan, and black, and a fixing device that fixes the toner image to a sheet. The sheet storage unit 130 includes four sheet feed trays 131, 132, 133, and 134 according to sheet sizes for example. Each of the sheet feed trays 131, 132, 133, and 134 stores a bundle of sheets in a corresponding sheet size.

The image forming apparatus 100 includes a sheet conveying device (not illustrated). The sheets stored in the sheet feed trays 131, 132, 133, and 134 of the sheet storage unit 130 are conveyed one by one by the sheet conveying device to the image forming unit 120, subjected to a toner image formation process, a fixing process, or the like, and discharged to a discharge tray (not illustrated). Furthermore, the sheet conveying device includes a reversing device that reverse a sheet to perform duplex printing. The reversing device conveys a sheet to a purging unit 135 adjacent to the sheet storage unit 130, and reverses the sheet by changing a sheet conveying direction.

The image forming apparatus 100 further includes a plurality of doors to remove, from the apparatus, a sheet jammed in the apparatus. Specifically, the image forming unit 120 includes a secondary-transfer-unit drawer 121 and a manual feed door 122, the sheet storage unit 130 includes a sheet-storage-unit door 136, and the purging unit 135 of the reversing device includes a purging-unit door 137. Furthermore, a toner replacement door 123 is provided on top of the secondary-transfer-unit drawer 121.

As illustrated in FIG. 2, a yellow toner container 151, a magenta toner container 152, a cyan toner container 153, and a black toner container 154 are arranged on the back side of the toner replacement door 123. The top surface of each of the toner containers 151, 152, 153, and 154 is arranged below the top exterior panel (top exterior member) 140 without a space. Therefore, the capacity of each of the toner containers 151, 152, 153, and 154 can be maximized. In this condition, when the operating member 200 is arranged on the top exterior panel 140, it is impossible to arrange a rotary shaft of the operating member 200 below the top exterior panel 140.

Figure 3A:
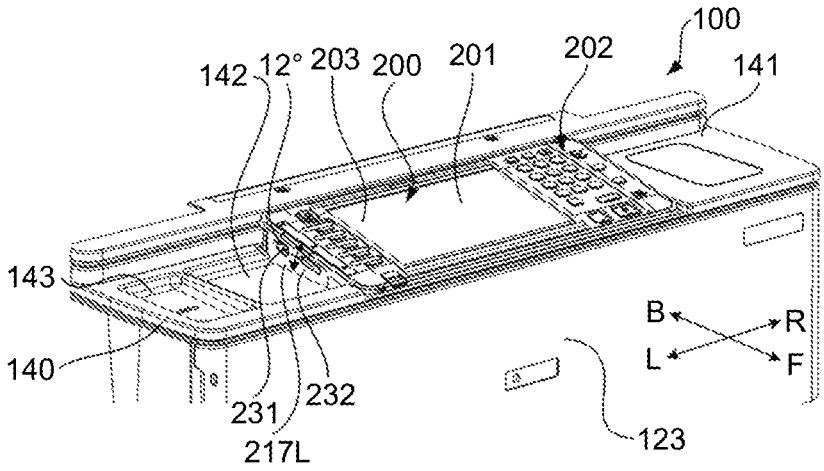
FIG. 3A is a perspective view illustrating a first posture of an operating member of the image forming apparatus.
Figure 3B:
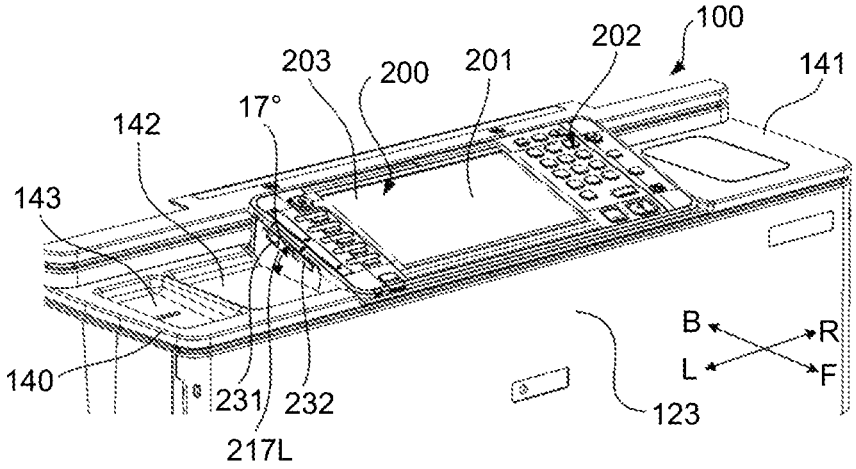
FIG. 3B is a perspective view illustrating a second posture of the operating member of the image forming apparatus.
Figure 4:
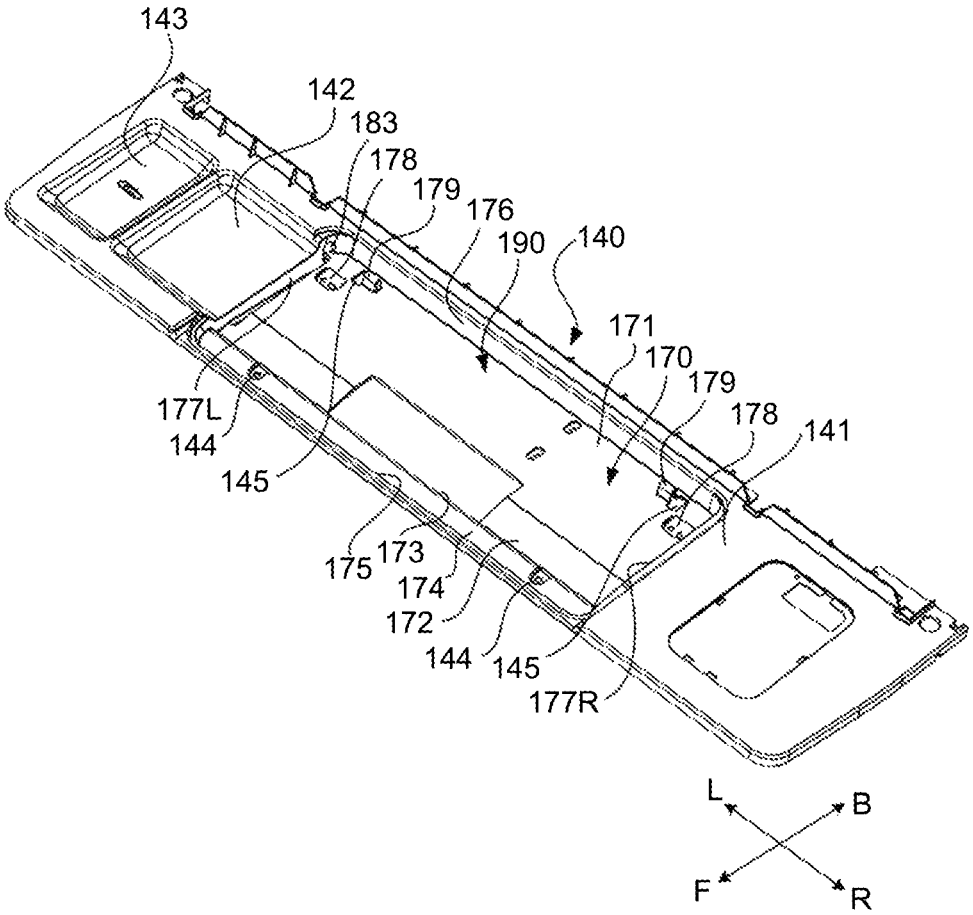
FIG. 4 is a perspective view illustrating a top side of a top exterior panel of the image forming apparatus.
Figure 5:
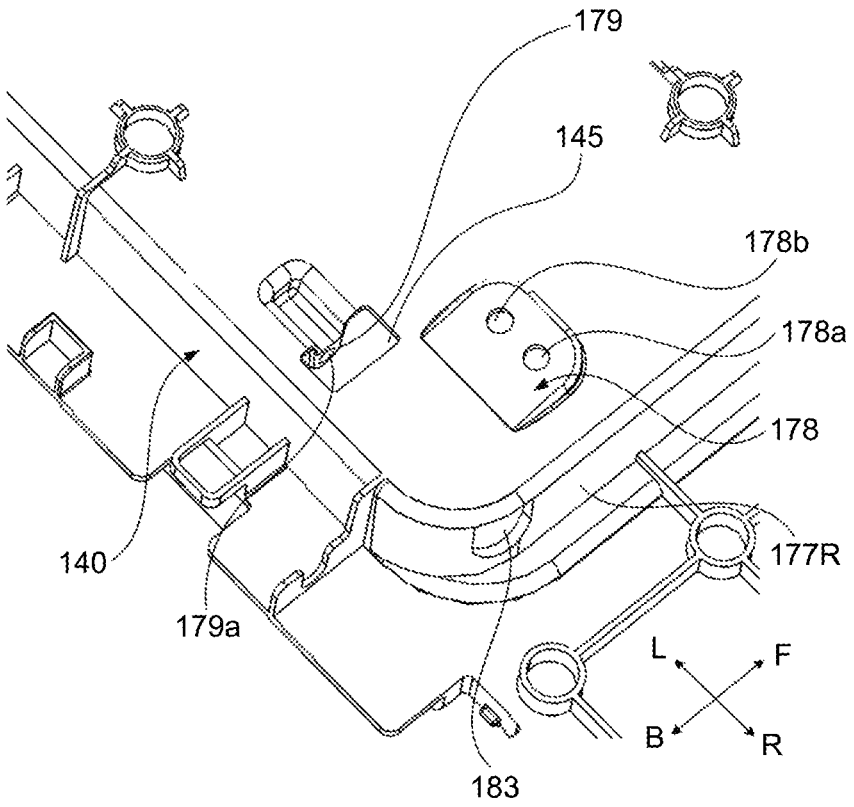
FIG. 5 is an enlarged perspective view illustrating a back side of the top exterior panel of the image forming apparatus.
Figure 6A:
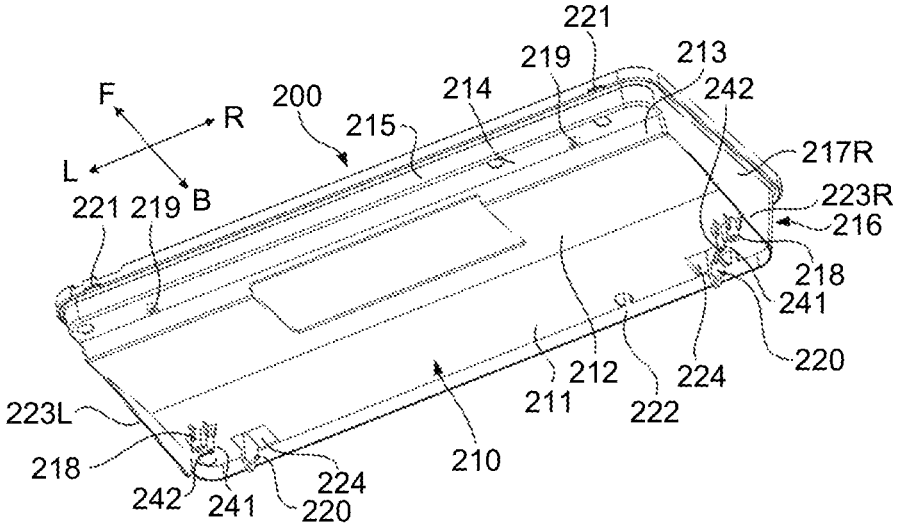
FIG. 6A is a perspective view illustrating a back side of the operating member of the image forming apparatus.
Figure 6B:
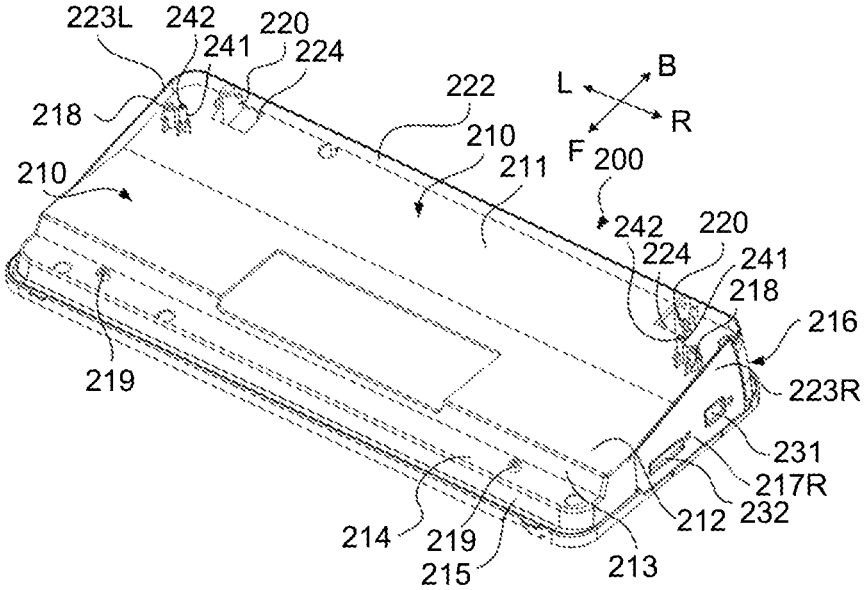
FIG. 6B is a perspective view illustrating the back side of the operating member viewed from a different direction.
Figure 7:
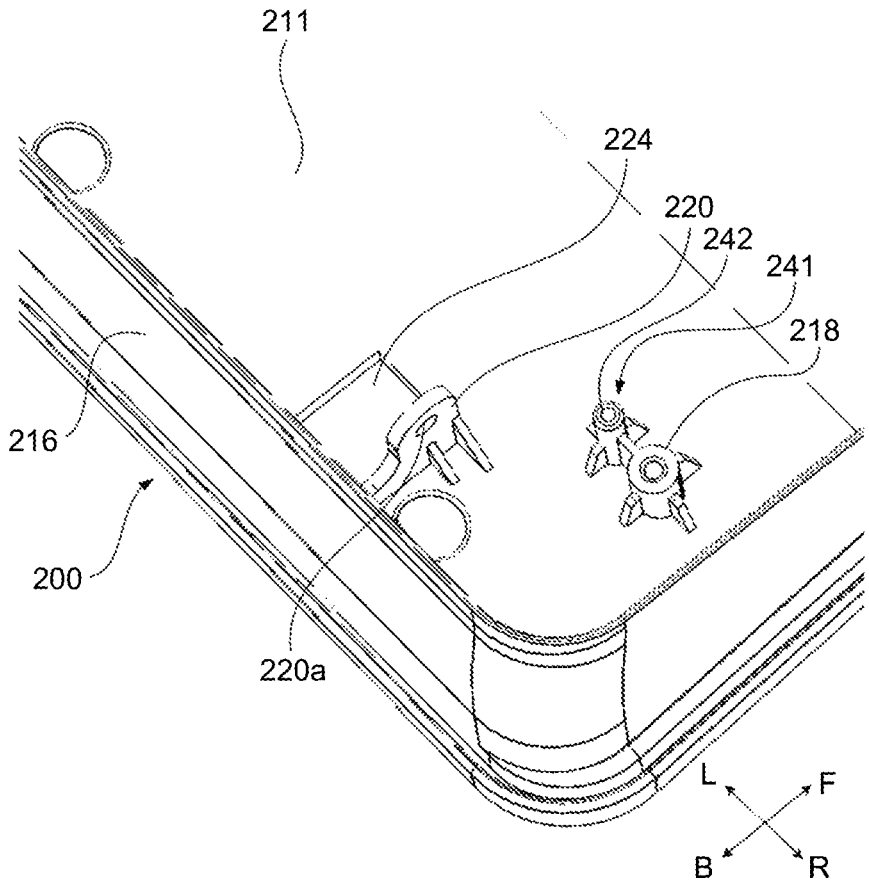
FIG. 7 is a perspective view illustrating main parts of the operating member of the image forming apparatus viewed from below.
Figure 8A:
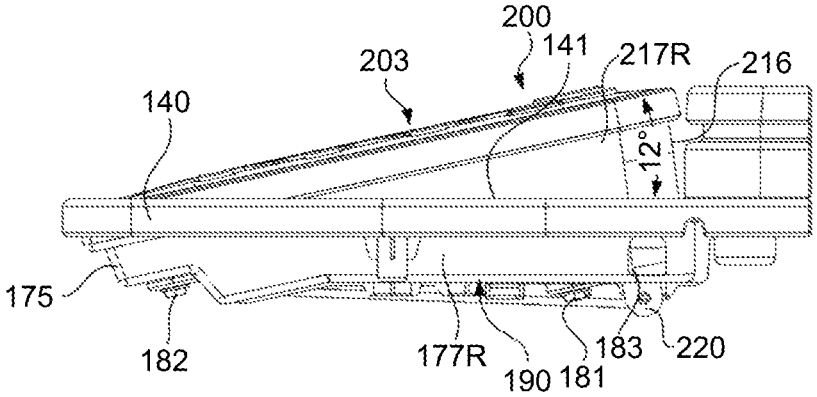
FIG. 8A is a side view of the operating member in the first posture in the image forming apparatus.
Figure 8B:
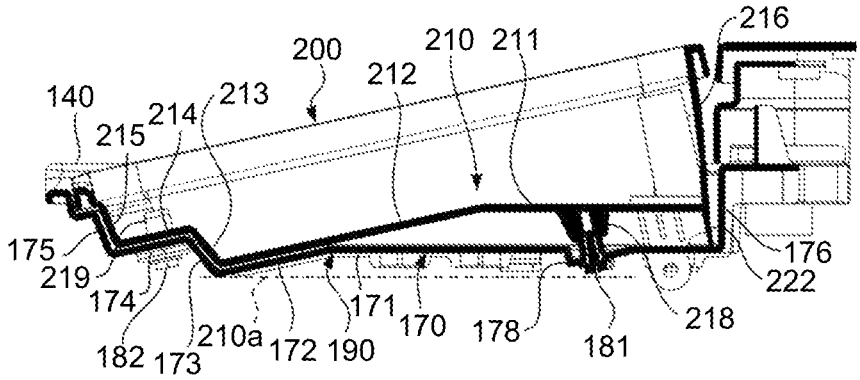
FIG. 8B is a cross-sectional view of the operating member in the first posture in the image forming apparatus.
Figure 8C:
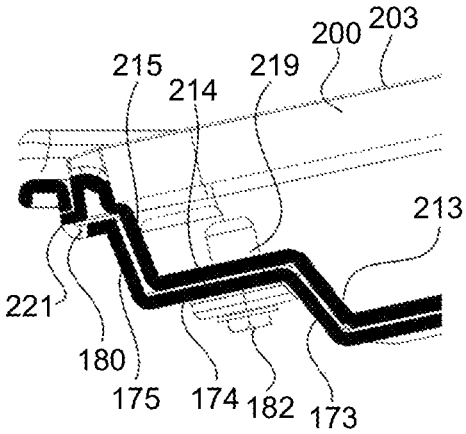
FIG. 8C is an enlarged cross-sectional view of the operating member in the first posture in the image forming apparatus.
Figure 9A:
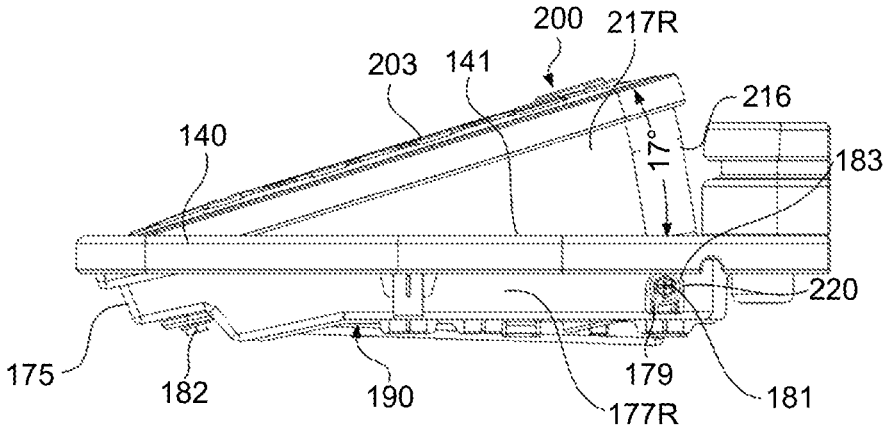
FIG. 9A is a side view of the operating member in the second posture in the image forming apparatus.
Figure 9B:
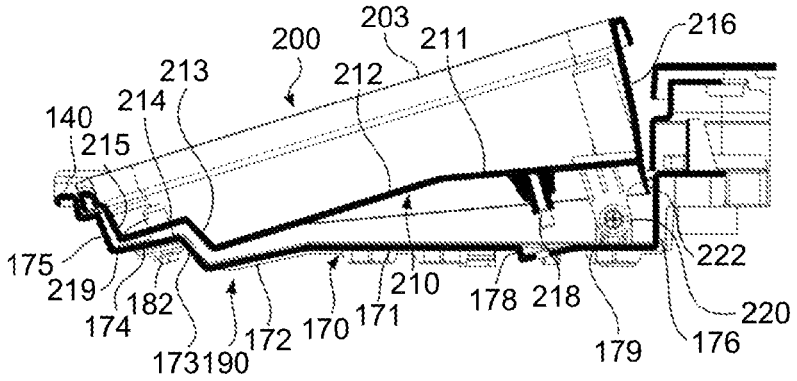
FIG. 9B is a cross-sectional view of the operating member in the second posture in the image forming apparatus.
Figure 9C:
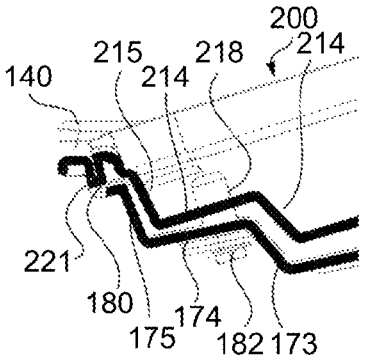
FIG. 9C is an enlarged cross-sectional view of the operating member in the second posture in the image forming apparatus.

The top exterior panel 140 and the operating member 200 will be explained below. FIG. 3A is a perspective view illustrating a first posture of the operating member 200 of the image forming apparatus 100. FIG. 3B is a perspective view illustrating a second posture of the operating member 200 of the image forming apparatus 100. FIG. 4 is a perspective view illustrating a top side of the top exterior panel 140 of the image forming apparatus 100. FIG. 5 is an enlarged perspective view illustrating a back side of the top exterior panel 140 of the image forming apparatus 100. FIG. 6A is a perspective view illustrating a back side of the operating member 200 of the image forming apparatus 100. FIG. 6B is a perspective view illustrating the back side of the operating member 200 viewed from a different direction. FIG. 7 is a perspective view illustrating main parts of the operating member 200 of the image forming apparatus 100 viewed from the back side. FIGS. 8A, 8B, and 8C are a side view, a cross-sectional view, and an enlarged cross-sectional view of the operating member 200 in the first posture in the image forming apparatus 100, respectively. FIGS. 9A, 9B, and 9C are a side view, a cross-sectional view, and an enlarged cross-sectional view of the operating member 200 in the second posture in the image forming apparatus 100, respectively.

As illustrated in FIG. 4, a holding recess 190 is provided on the center of the top exterior panel 140 in the width direction. The operating member 200 is arranged in the holding recess 190. As illustrated in FIGS. 3A and 3B, the operating member 200 includes, as units for operation, a touch panel 201 and operation buttons 202 including a numerical keypad, a start key button, and the like, on a top surface 203. The operating member 200 is arranged such that the top surface 203 is downwardly inclined toward the front side by taking into account the operability. Furthermore, in the top exterior panel 140, a horizontal flat part 141 is provided on the right side of the operating member 200. Moreover, recesses 142 and 143 for placing clips or the like attached to documents are provided on the left side of the operating member 200.

In the image forming apparatus 100, it is possible to selectively mount the operating member 200 on the top exterior panel 140 either in a first posture (see FIG. 3A and FIGS. 8A to 8C) or in a second posture (see FIG. 3B and FIGS. 9A to 9C). As a factory setting of the image forming apparatus 100, the operating member 200 is mounted in the first posture. In the first posture, the operating member 200 is arranged such that the rear side is located higher than the operator stand side, and the top surface 203 is downwardly inclined toward the front side with respect to the top exterior panel 140. In this case, the top surface 203 is arranged so as to be inclined by a first inclination angle, such as 12 degrees, with respect to the flat part 141 of the top exterior panel 140.

At an installation site, to prevent reflection of illumination in the operating member for example, the operating member 200 may be arranged in the second posture by changing the mounting state. In this case, the top surface 203 of the operating member 200 is arranged so as to be inclined by a second inclination angle, such as 17 degrees, which is different from the first inclination angle in the first posture, with respect to the flat part 141 of the top exterior panel 140. Such a change in the posture of the operating member 200 may be performed by a service person, based on a request from a customer when the apparatus is installed or when after-sales service is provided.

As illustrated in FIGS. 3A and 3B, on a left side surface 217L of the operating member 200, a universal serial bus (USB) port 231 for inserting a USB flash memory and a memory card slot 232 for attaching a secure digital (SD) memory card are arranged, as recording medium connecting units to which external recording media are connected. In this example, to enable to easily insert the USB flash memory thicker than the SD memory card, the USB port 231 is arranged on the rear side where an interval from the top exterior panel 140 can be ensured easily. Furthermore, as illustrated in FIG. 3B, if the operating member 200 is arranged in the second posture, the interval between each of the USB port 231 and the memory card slot 232 and the top exterior panel 140 is increased, so that it becomes easier to insert a thick USB flash memory to the USB port 231.

A mounting member used to fix the operating member 200 to the top exterior panel 140 will be explained first, and the structures of the top exterior panel 140 and the operating member 200 will be subsequently explained. In the image forming apparatus 100, both when the operating member 200 is mounted in the first posture and when the operating member 200 is mounted in the second posture, the operating member 200 is fixed with two rear screws 181 and 181 serving as mounting members, and the front side of the operating member is fixed with two front screws 182 and 182 serving as mounting members (see FIGS. 8A to 8C and FIGS. 9A to 9C). The rear screws 181 and the front screws 182 are arranged so as to penetrate through different members, and fix, as fastening members that fix the different members, the operating member 200 to the top exterior panel 140.

First, the structure of the top exterior panel 140 will be explained. As illustrated in FIG. 4 and FIG. 5, the holding recess 190 is provided on the top exterior panel 140. A bottom wall 170 includes, from the rear side, a first bottom wall portion 171, a second bottom wall portion 172, a third bottom wall portion 173, and a fourth bottom wall portion 174. On the fourth bottom wall portion 174, screw insertion holes 144 and 144 are formed in which the front screws 182 and 182 are inserted when the operating member 200 is mounted in the first posture or the second posture. Furthermore, on the first bottom wall portion 171, protrusions (serving as first mounting parts) 178 and 178 are provided, on which the rear screws 181 and 181 are attached when the operating member 200 is mounted in the first posture and which protrude from the back surface of the top exterior panel 140. On the protrusions 178 and 178, screw holes 178*a* serving as first insertion holes in which the rear screws 181 and 181 are inserted, and positioning holes 178*b* for determining the position of the operating member 200 are formed (see FIG. 5).

Furthermore, as illustrated in FIG. 4 and FIG. 5, on the first bottom wall portion 171, mounting protrusions 179 and 179 (serving as second mounting parts) are provided in a standing manner, on which the rear screws 181 and 181 are attached when the operating member 200 is mounted in the second posture. The mounting protrusions 179 are formed with screw holes 179*a* serving as second insertion holes in which the rear screws 181 are screwed. Furthermore, on the first bottom wall portion 171, holes 145 and 145 are opened adjacent to the mounting protrusions 179 and 179.

The holding recess 190 includes the bottom wall 170, a front side wall 175 located on the operator side, a rear side wall 176 located on the opposite side of the front side wall 175, and a left wall 177L and a right wall 177R serving as both lateral side walls that connect the front side wall 175 and the rear side wall 176. On the left wall 177L and the right wall 177R, tool holes 183 and 183 are provided, through which the rear screws 181 and 181 are inserted in the horizontal direction and fastened with a tool when the operating member 200 is arranged in the second posture.

Furthermore, as illustrated in FIG. 8C and FIG. 9C, on the front side wall 175 of the top exterior panel 140, holes 180 and 180 serving as engaged members are opened, in which protrusions 221 and 221 of the operating member 200 to be described later are inserted.

Next, the operating member 200 will be explained. As illustrated in FIGS. 6A, 6B, and 8B, the operating member 200 includes the top surface 203 as described above, a bottom surface 210 arranged on the opposite side of the top surface 203 so as to face the holding recess 190, a front side surface 215 arranged on the operator stand side, and a rear side surface 216 on the opposite side of the front side surface 215. Furthermore, the operating member 200 includes the left side surface 217L and a right side surface 217R serving as both lateral side surfaces that connect the front side surface 215 and the rear side surface 216. The bottom surface 210 of the operating member 200 includes, from the rear side, a first bottom surface 211, a second bottom surface 212, a third bottom surface 213, and a fourth bottom surface 214. The first bottom surface 211, the second bottom surface 212, the third bottom surface 213, the fourth bottom surface 214 are formed such that the surfaces, as a whole, come closer to the top surface 203 toward the front side.

Furthermore, as illustrated in FIGS. 6A, 6B, and 7, on the first bottom surface 211, vertical fixing parts 218 and 218 are arranged, to which the rear screws 181 and 181 are fastened in a direction corresponding to the height direction of the main body of the apparatus (a direction crossing the L-R direction and the F-B direction in FIG. 7). The vertical fixing parts 218 and 218 are arranged in a downward direction with respect to the top surface 203.

Moreover, as illustrated in FIGS. 6A, 6B, and 7, on the first bottom surface 211, horizontal fixed parts 220 and 220 are provided, which protrude downward and serve as fixing parts in second positions where the rear screws 181 and 181 are fastened in a direction corresponding to the width direction of the main body of the apparatus (the L-R direction in FIG. 7) when the operating member 200 is fixed in the second posture. On each of the horizontal fixed parts 220 and 220, a screw insertion hole 220*a* is formed, as a horizontal fastening member insertion hole, in which the rear screw 181 is insertable. On the first bottom surface 211, openings 224 and 224 are opened, in which the mounting protrusions 179 and 179 are inserted when the operating member 200 is arranged in the first posture as will be described later.

Furthermore, as illustrated in FIGS. 6A, 6B, and 8B, on the fourth bottom surface 214, front fixing parts 219 and 219 are provided, to which the front screws 182 and 182 are fastened. Both in the first posture and in the second posture, the front screws 182 and 182 are screwed in the front fixing parts 219 and 219.

Moreover, as illustrated in FIGS. 6A, 6B, 8C, and 9C, on the front side surface 215, the two protrusions 221 and 221 as described above are provided, which serve as engaging members and which protrude toward the front side. The protrusions 221 and 221 are inserted in the holes 180 and 180 serving as the engaged members, and fix the front side of the operating member 200 to the top exterior panel 140 together with the front screws 182 and 182. A concave-convex relationship between the protrusions 221 and 221 and the holes 180 and 180 may be reversed such that holes are formed on the front side surface 215 and protrusions are provided on the front side wall 175.

Furthermore, as illustrated in FIGS. 6A, 6B, 8B, and 9B, the rear side surface 216 has a shape, such as a cylindrical surface, that maintains approximately constant interval from the rear side wall 176 of the holding recess 190 both when the operating member 200 is in the first posture and in the second posture. It is better if the interval is smaller. The shape of the rear side surface 216 is not limited to the cylindrical surface, and may be any shape as long as the same interval from the rear side surface 216 is maintained when the posture of the operating member 200 is changed.

Furthermore, as illustrated in FIGS. 6A, 6B, 8B, and 9B, a rear plate 222, a left side plate 223L, and a right side plate 223R, each of which a flat plate extending downward, are provided on the rear side surface 216, the left side surface 217L, and the right side surface 217R of the operating member 200, respectively. The rear plate 222, the left side plate 223L, and the right side plate 223R prevent a gap from being generated between the rear side of the operating member 200 and the rear side wall 176 of the holding recess 190 when the operating member 200 is arranged in the second posture as illustrated in FIG. 9B. Therefore, it becomes possible to prevent a foreign matter, such as a clip, from being entered in the gap between the operating member 200 and the holding recess 190.

As illustrated in FIGS. 6A and 6B, the left side plate 223L and the right side plate 223R are provided such that the dimensions in a direction corresponding to the height direction of the main body of the apparatus (the direction crossing the L-R direction and the F-B direction in FIGS. 6A and 6B) become smaller on the operator stand side (on the side in the F direction) than the rear side. Each of the left side plate 223L and the right side plate 223R also blocks a gap between the operating member 200 and each of the left wall 177L and the right wall 177R, to thereby prevent entrance of a foreign matter.

Figure 10:
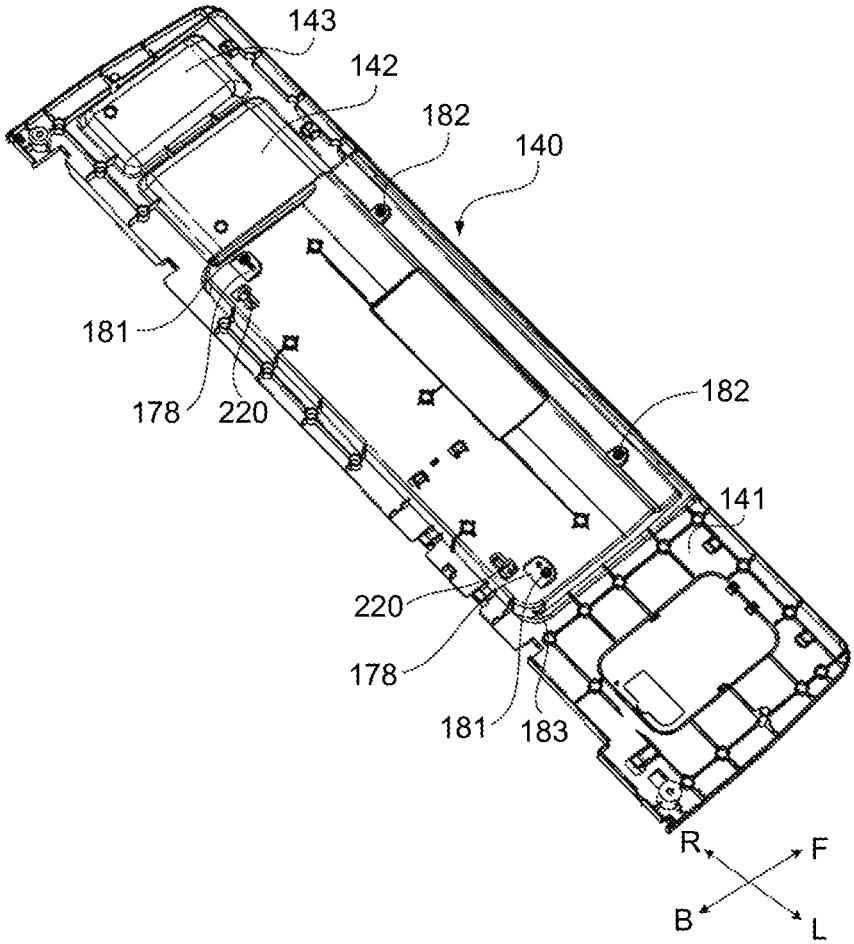
FIG. 10 is a perspective view illustrating a state in which the operating member is mounted in the first posture on the top exterior panel of the image forming apparatus, when viewed from the back side.
Figure 11:
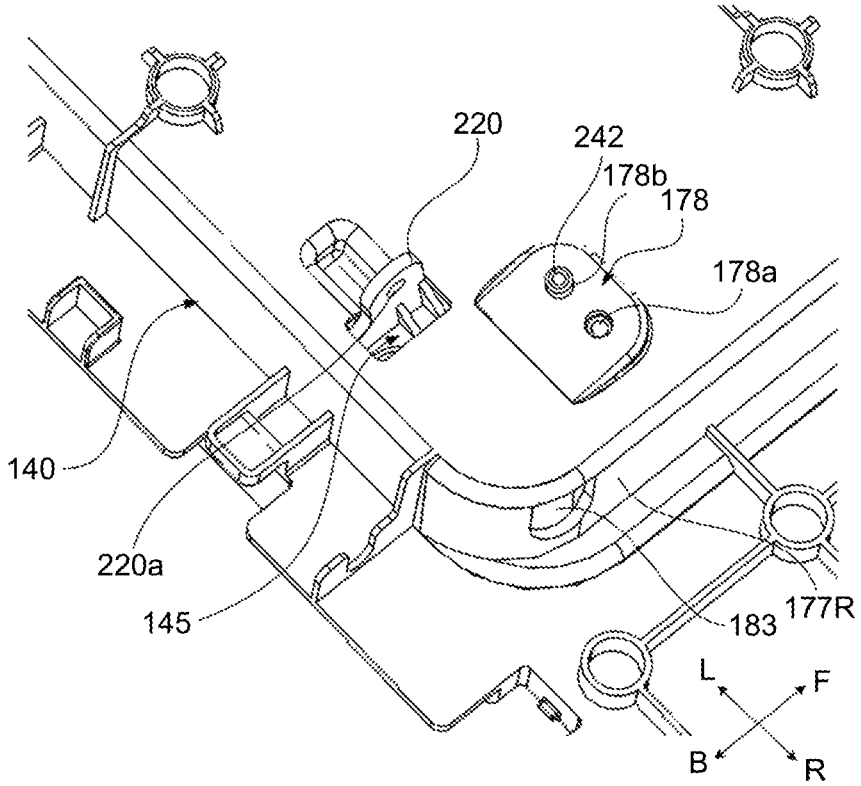
FIG. 11 is an enlarged perspective view illustrating the state in which the operating member is mounted in the first posture on the top exterior panel of the image forming apparatus, when viewed from the back side.
Figure 12:
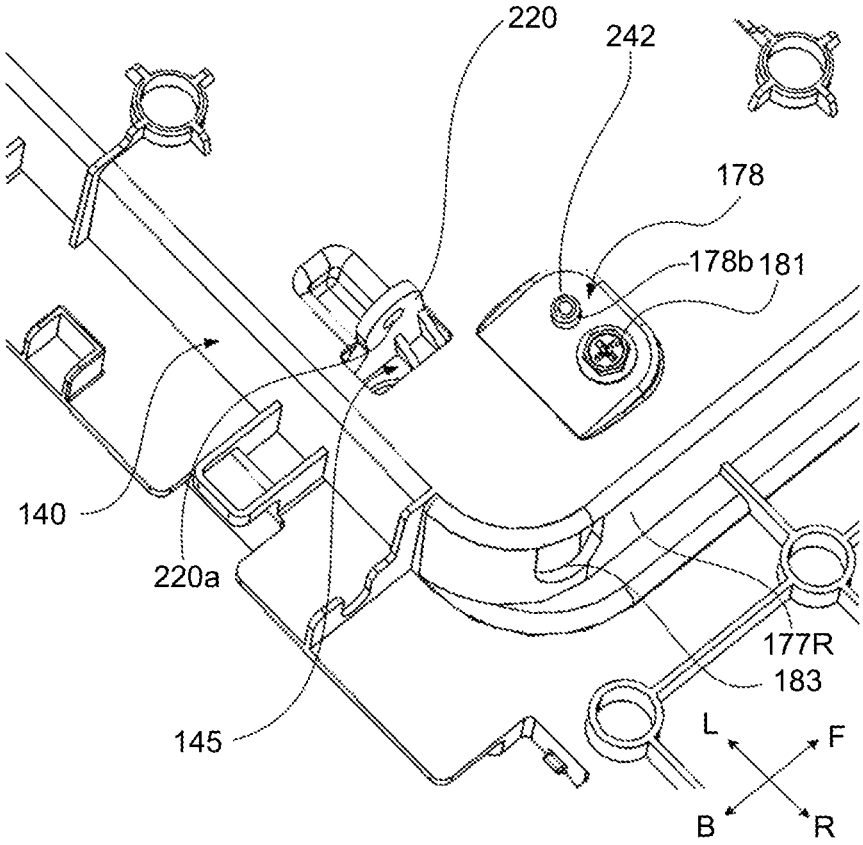
FIG. 12 is an enlarged perspective view illustrating a state in which the operating member illustrated in FIG. 11 is fixed with rear screws.

Next, the procedure for fixing the operating member 200 in each posture will be explained with reference to FIGS. 8A to 15. First, a case will be explained in which the operating member 200 is arranged in the first posture (see FIGS. 8A to 8C). FIG. 10 is a perspective view illustrating a state in which the operating member is mounted in the first posture on the top exterior panel of the image forming apparatus, when viewed from the back side. FIG. 11 is an enlarged perspective view illustrating the state in which the operating member is mounted in the first posture on the top exterior panel of the image forming apparatus, when viewed from the back side. FIG. 12 is an enlarged perspective view illustrating a state in which the operating member illustrated in FIG. 11 is fixed with the rear screws. As a factory setting of the image forming apparatus 100, the operating member 200 is mounted in the first posture on the top exterior panel 140.

First, the operating member 200 is arranged in the first posture on the bottom wall 170. In this case, as illustrated in FIG. 8B, the bottom edge of the rear plate 222 is brought into contact with the first bottom wall portion 171, and edges of the vertical fixing parts 218 and 218 are brought into contact with the protrusions 178 and 178. Furthermore, the second bottom surface 212 is brought into contact with the second bottom wall portion 172, the fourth bottom surface 214 is brought into contact with the fourth bottom wall portion 174, and the front side surface 215 is brought into contact with the front side wall 175. In this state, the horizontal fixed parts 220 and 220 are inserted in the holes 145 and 145 of the first bottom wall portion 171. Furthermore, the mounting protrusions 179 and 179 are inserted in the openings 224 and 224 of the operating member 200. Therefore, as illustrated in FIG. 11, end protrusions 242 and 242 of the positioning units 241 and 241 arranged adjacent to the vertical fixing parts 218 and 218 are entered in the positioning holes 178*b* and 178*b* of the top exterior panel 140, so that the position of the operating member 200 is determined.

In this state, the protrusions 221 and 221 of the operating member 200 are inserted in the holes 180 and 180 of the top exterior panel 140. Subsequently, as illustrated in FIG. 12, the rear screws 181 and 181 are inserted in the screw holes 178*a* and 178*a* of the protrusions 178 and 178 on the top exterior panel 140 and in the vertical fixing parts 218 and 218 of the operating member 200, from the back side of the top exterior panel 140. Therefore, the rear screws 181 and 181 are attached to first positions.

Furthermore, the front screws 182 and 182 are screwed in the front fixing parts 219 and 219 through the screw insertion holes 144 and 144. The rear screws 181 and 181 and the front screws 182 and 182 are screwed in the vertical direction from the back side of the holding recess 190; therefore, an operator who performs assembly is able to operate a tool in the vertical direction and the operation becomes easy.

If the assembly is completed, the operating member 200 is fixed in the first posture to the holding recess 190 of the top exterior panel 140. In this state, a gap between each of the front side wall 175, the rear side wall 176, the left wall 177L, and the right wall 177R of the holding recess 190 and each of the front side surface 215, the rear side surface 216, the left side surface 217L, and the right side surface 217R of the operating member 200 is small. Therefore, it becomes possible to prevent entrance of a foreign matter, such as a clip.

Figure 13:
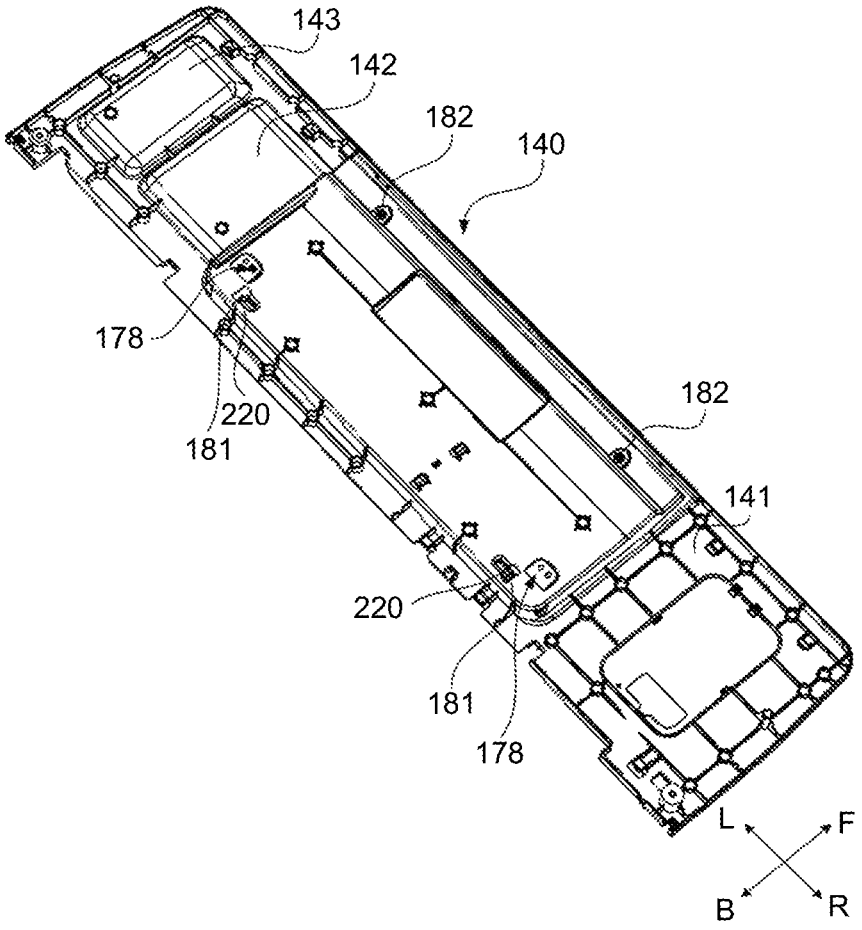
FIG. 13 is a perspective view illustrating a state in which the operating member is mounted in the second posture on the top exterior panel of the image forming apparatus, when viewed from the back side.
Figure 14:
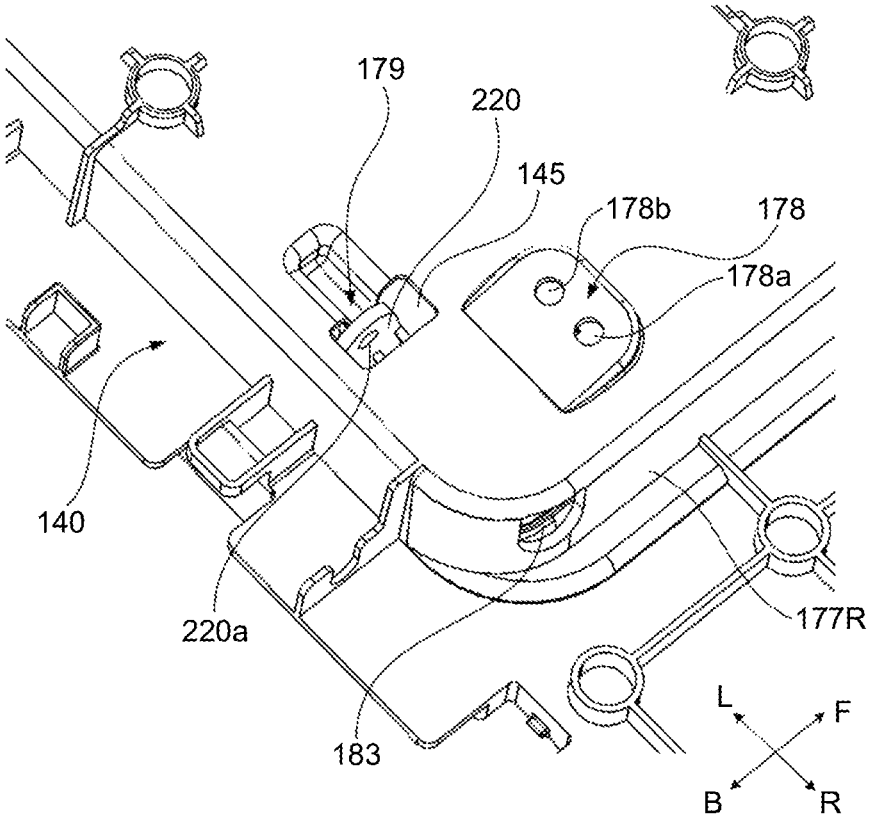
FIG. 14 is an enlarged perspective view illustrating the state in which the operating member is mounted in the second posture on the top exterior panel of the image forming apparatus, when viewed from the back side.
Figure 15:
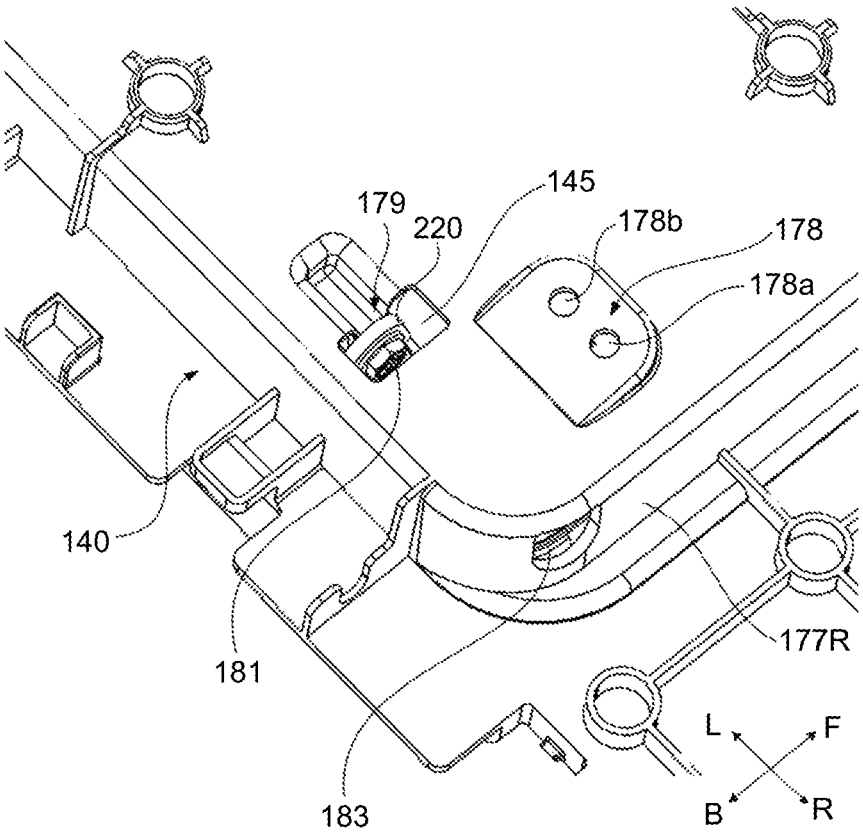
FIG. 15 is an enlarged perspective view illustrating a state in which the operating member illustrated in FIG. 14 is fixed with the rear screws.

Next, a case will be explained in which the operating member 200 is arranged in the second posture (see FIGS. 9A to 9C). FIG. 13 is a perspective view illustrating a state in which the operating member is mounted in the second posture on the top exterior panel of the image forming apparatus, when viewed from the back side. FIG. 14 is an enlarged perspective view illustrating the state in which the operating member is mounted in the second posture on the top exterior panel of the image forming apparatus, when viewed from the back side. FIG. 15 is an enlarged perspective view illustrating a state in which the operating member illustrated in FIG. 14 is fixed with the rear screws. This setting is made by a service person based on a request from a user after installation of the image forming apparatus 100 on which the operating member 200 is mounted in the first posture.

To arrange the operating member 200 in the second posture, the service person dismounts the top exterior panel 140 together with the operating member 200 from the main body of the image forming apparatus 100, detaches the rear screws 181 and 181, and loosens the front screws 182 and 182. Subsequently, the operating member 200 is arranged in the second posture and fixed to the holding recess 19. In this case, the operating member 200 is arranged on the holding recess 190 in the state as illustrated in FIGS. 9B, 9C, and 14.

In the second posture, the front side surface 215 is arranged close to the front side wall 175, and the protrusions 221 and 221 are inserted in the holes 180 and 180. Furthermore, while the edge of the rear plate 222 is separated from the first bottom wall portion 171, a large gap is not generated between the rear plate 222 and the rear side wall 176. Similarly, a large gap is not generated between each of the left side plate 223L and the right side plate 223R and each of the left wall 177L and the right wall 177R.

Moreover, a slight gap is generated between the second bottom surface 212 and the second bottom wall portion 172, between the third bottom surface 213 and the third bottom wall portion 173, and between the fourth bottom surface 214 and the fourth bottom wall portion 174. In this state, the rear screws 181 and 181 are inserted via the tool holes 183 and 183 with a tool, and attached and fixed to the horizontal fixed parts 220 and 220 and the mounting protrusions 179 and 179 as illustrated in FIG. 15. Therefore, the rear screws 181 and 181 are attached to the second positions, which are different from the first positions.

Incidentally, if the operating member 200 is fixed to the top exterior panel 140 without using the front screws 182 and 182, the operating member 200 is arranged in the second posture while the protrusions 221 and 221 remain inserted in the holes 180 and 180, and then fixed with the rear screws 181 and 181. Therefore, the operating member 200 is fixed in the second posture to the holding recess 190 of the top exterior panel 140.

In the present embodiment, the rear screws 181 and 181 and the front screws 182 and 182 do not protrude below a bottommost level 210*a* of the holding recess 190 (see FIG. 8B) both in the first posture and in the second posture. Therefore, it becomes possible to prevent reduction in the capacity of a toner storage space arranged just below the front screws 182 and 182, due to the front screws 182 and 182.

Furthermore, in the image forming apparatus 100 according to the present embodiment, the operating member 200 is arranged on the holding recess 190 of the top exterior panel 140 from the top side both when the operating member 200 is mounted in the first posture and when the operating member 200 is mounted in the second posture. Furthermore, in either posture, the rear side of the top exterior panel 140 is fixed with the rear screws 181 and 181 serving as two fastening members and the front side is fixed with the two front screws 182 and 182, from the back side of the top exterior panel 140. In this case, the rear screws 181 and 181 and the front screws 182 and 182 fix the operating member 200 from the back side of the top exterior panel 140. Therefore, at least head portions of the rear screws 181 and 181 and the front screws 182 and 182 are covered by the top exterior panel 140 and are not externally visible. Therefore, it becomes possible to prevent a user from carelessly operating the rear screws 181 and 181 and the front screws 182 and 182.

Incidentally, in either posture, the front side of the operating member 200 is fixed by engaging the holes 180 serving as the engaged members of the holding recess 190 and the protrusions 221 serving as the engaging members of the operating member 200. Meanwhile, the front side of the operating member 200 may be fixed by only the front screws 182 and 182 or by only engagement between the engaging members and the engaged members.

As described above, according to the image forming apparatus 100 of the present embodiment, components used to change the posture of the operating member 200 do not protrude below the top exterior panel 140. Therefore, it becomes possible to easily ensure the capacities of the toner containers 151, 152, 153, and 154 arranged just below the top exterior panel 140.

Furthermore, a complex structure is not needed as a mechanism for changing the posture of the operating member 200, so that the apparatus can be made compact and good appearance is maintained. Moreover, components, such as a rotary shaft or a torque hinge, are not needed, so that costs for the components can be reduced. Furthermore, the fastening members, the holes for fastening, or the like are not externally visible, so that good appearance is maintained. Moreover, even when the posture of the operating member 200 is changed, it is possible to maintain a constant interval between the operating member 200 and the holding recess 190. Therefore, it becomes possible to minimize the dimensions of gaps, prevent a foreign matter such as a clip or a pen from falling in the gaps, and maintain good appearance.

Incidentally, in the present embodiment, an example is explained in which the operating member 200 is mounted in two different postures such as the first posture and the second posture; however, the operating member 200 may be mounted in three or more different postures. In this case, two or more screw holes are provided in different height positions on the mounting protrusion 179, and two or more screw insertion holes are provided in different height positions on the horizontal fixed parts 220 and 220. Then, rear screws are attached to arbitrary positions for fixation. In this configuration, it becomes possible to fix the operating member 200 to the holding recess 190 of the top exterior panel 140 in a desired posture among multiple postures.

Furthermore, in the present embodiment, it is explained that the fastening members, such as screws, are employed as the mounting members; however, other members may be employed as the mounting members. Specifically, it may be possible to employ, as the mounting members, engaging members such as a pin member and a hook member to be engaged with each other, a hook and loop fastener (for example, Velcro tape (registered trademark)) formed of a hook member, in which hook-shaped parts are densely arranged, and a loop member, in which loop-shaped parts are densely arranged, or a magnet that attaches the operating member and a planer exterior member by a magnetic force.

According to an embodiment of the present invention, a rotary shaft or a support structure are not needed, so that it becomes possible to reduce costs of components and the size of the apparatus.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

a top exterior member having a holding recess, the holding recess including at least a bottom wall and a side wall, the bottom wall having a first through hole and a first protrusion therein, the first protrusion including a first fastening member insertion hole that opens toward the side wall of the holding recess; and an operating member on the top exterior member, the operating member configured to be operated by an operator to give an instruction on operation, and the operating member including a bottom surface, the bottom surface having a second protrusion and a third protrusion therein, the second protrusion including a second fastening member insertion hole that opens toward the bottom wall of the holding recess, and the third protrusion including a second through hole that opens toward the side wall of the holding recess, wherein, the operating member is configured to be selectively fixed to the top exterior member in one of a first posture and a second posture, if the operating member is in the first posture, a fastening member is inserted into the first through hole and the second fastening member insertion hole of the second protrusion so that the operating member is fixed to the top exterior member such that the operating member is inclined by a first inclination angle with respect to the top exterior member while the operating member is being held by the holding recess, and if the operating member is in the second posture, the fastening member is inserted into the first fastening member insertion hole and the second through hole so that the operating member is fixed to the top exterior member such that the operating member is inclined by a second inclination angle different from the first inclination angle with respect to the top exterior member.

2. The image forming apparatus according to claim 1, wherein the fastening member does not protrude below a bottommost level of the holding recess.

3. The image forming apparatus according to claim 1, wherein a rear side of the operating member is fixed to the top exterior member with the fastening member, and a front side of the operating member is fixed to the top exterior member at least by engaging an engaging member on the holding recess and an engaged member on a front side of the operating member or by attaching a fastening member from the back side of the top exterior member.

4. The image forming apparatus according to claim 1, wherein a rear side of the operating member has a shape that maintains an approximately constant interval from a rear side of the holding recess both when the operating member is in the first posture and when the operating member is in the second posture.

5. The image forming apparatus according to claim 1, further comprising:

a plate member that extends downward and is arranged on each of a rear side and two lateral sides of the operating member.

6. The image forming apparatus according to claim 5, wherein each of the plate members on each of the lateral side of the operating member extends toward a bottom wall of the holding recess, the each of the plate members is arranged such that a size of each of the plate members in the direction corresponding to the height direction of a main body of the image forming apparatus is smaller on the side where an operator stands than the rear side.

7. The image forming apparatus according to claim 1, further comprising:

a recording medium connecting unit arranged on at least one of the lateral sides of the operating member, the recording medium connecting an external recording medium.

8. The image forming apparatus according to claim 1, wherein the second inclination angle is greater than the first inclination angle.

* * * * *